US010443821B2

(12) United States Patent
Chen

(10) Patent No.: US 10,443,821 B2
(45) Date of Patent: Oct. 15, 2019

(54) MODULAR ILLUMINATION ASSEMBLY

(71) Applicant: Amax Lighting, Inc., Santa Fe Springs, CA (US)

(72) Inventor: Michael Chen, Whittier, CA (US)

( * ) Notice: Subject to any disclaimer, the term of this patent is extended or adjusted under 35 U.S.C. 154(b) by 288 days.

(21) Appl. No.: 15/613,094

(22) Filed: Jun. 2, 2017

(65) Prior Publication Data

US 2018/0347792 A1 Dec. 6, 2018

(51) Int. Cl.

| | |
|---|---|
| ***F21V 19/00*** | (2006.01) |
| ***F21Y 115/10*** | (2016.01) |
| ***F21S 8/06*** | (2006.01) |
| ***F21S 8/04*** | (2006.01) |
| ***F21S 2/00*** | (2016.01) |
| ***F21K 9/27*** | (2016.01) |

(52) U.S. Cl.

CPC ..... *F21V 19/008* (2013.01); *F21K 9/27* (2016.08); *F21S 2/00* (2013.01); *F21S 8/046* (2013.01); *F21S 8/061* (2013.01); *F21Y 2115/10* (2016.08)

(58) Field of Classification Search

CPC ..... F21Y 2103/10; F21Y 2105/10; F21Y 2113/13; F21Y 2105/12; F21V 23/06; F21V 19/003; F21V 23/005; F21V 15/01

USPC ..... 362/219, 225, 217.1–217.17

See application file for complete search history.

(56) References Cited

U.S. PATENT DOCUMENTS 7,658,509 B2 * 2/2010 Summers ..... F21V 19/001 362/218
8,956,013 B1 * 2/2015 Shew ..... F21S 9/022 362/249.02
2006/0002100 A1 * 1/2006 Herst ..... F21S 8/06 362/257
2012/0195032 A1 * 8/2012 Shew ..... H02J 9/065 362/183
2013/0051008 A1 * 2/2013 Shew ..... H02J 9/065 362/235
2013/0182422 A1 * 7/2013 Guilmette ..... F21V 21/00 362/184
2014/0168961 A1 * 6/2014 Dubord ..... F21V 21/14 362/225
2014/0292198 A1 * 10/2014 Sanders ..... F21V 15/01 362/218
2015/0316238 A1 * 11/2015 Guilmette ..... H01R 25/14 362/218

* cited by examiner

*Primary Examiner* — William J Carter
(74) *Attorney, Agent, or Firm* — Tommy S F Wang; Wang IP Law Group, P.C.

(57) ABSTRACT

A modular illumination assembly provides at least one elongated light emitting diode lamp that joins other light emitting diode lamps in parallel series, through connecting junction boxes. The lamp comprises a shield that at least partially covers the lamp to directionally guide the emanated light in a desired direction. A pair of lamp holders provide circuitry and a switch for operation of the lamp. The lamp holders also comprise an adjustable retention member to fasten the termini of the lamp to restrict lateral slippage by the lamp. The lamp holders also comprise an anchor to receive a cable for hanging the light emitting diode lamp. The junction box forms an elongated ridge, and the lamp holder forms an elongated slot. The ridge and the slot slidably engage to enable detachable attachment between the junction box and the lamp holder, so as to connect multiple lamps in a parallel arrangement.

20 Claims, 9 Drawing Sheets

MODULAR ILLUMINATION ASSEMBLY

FIELD OF THE INVENTION

The present invention relates generally to a modular illumination assembly. More so, the present invention relates to an illumination assembly that provides at least one elongated light emitting diode lamp that is adapted to join multiple light emitting diode lamps in parallel series through connecting junction boxes, and whereby the light emitting diode lamp comprises a shield that directionally guides the emitted light in a desired direction; and whereby a pair of lamp holders provide circuitry and a switch for operation of the lamp, and also comprise an adjustable retention member to fasten the termini of the lamp to restrict lateral slippage by the lamp, and also comprise an anchor to receive a cable for hanging the light emitting diode lamp: and whereby the junction box forms an elongated ridge and the lamp holder forms an elongated slot to enable detachable attachment therebetween, so as to form a series of parallel lamps.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, fluorescent lighting consists of long slender tubes, typically 4' long with a diameter of LEDs emit light in a very narrow band of wavelengths, emitting light of a color characteristic of the energy bandgap of the semiconductor material used to make the LED. To emit white light from LEDs requires either mixing light from LEDs of various colors, or using a phosphor to convert sonic of the light to other colors.

Often, LED lamps attached at their ends to a housing that covers an upper portion of the lamps. The housing usually directs the light towards the ground and provides protection to the lamp. The housing also regulates electrical current to the lamp.

Generally, these LED lamps provide some beneficial features. However, they suffer from a number of limitations, including but not limited to, uneven light distribution and brightness, high material and component costs, difficult and time-consuming, assembly, and cumbersome housing configurations that hamper installation and thus prevent custom applications.

Other proposals have involved mounting LED lamps. The problem with these illumination devices is that the require a large, bulky housing to mount the lamps. Also, the emanated light is not directionally guided. Even though the above cited illuminating devices meet some of the needs of the market, a modular illumination assembly that provides at least one elongated light emitting diode lamp that is adapted to join multiple light emitting diode lamps in parallel series through connecting junction boxes, and whereby the light emitting diode lamp comprises a shield that directionally guides the emitted light in a desired direction, is still desired.

SUMMARY

Illustrative embodiments of the disclosure are generally directed to a modular illumination assembly. The modular illumination assembly provides at least one elongated light emitting diode lamp that is adapted to join multiple light emitting diode lamps in parallel series through connecting junction boxes. The light emitting diode lamp comprises a shield that directionally guides the emitted light in a desired direction, such as towards a ground surface. A pair of lamp holders provide circuitry and a switch for operation of the lamp. The lamp holders also comprise an adjustable retention member to fasten the termini of the lamp to restrict lateral slippage by the lamp. The lamp holders also comprise an anchor to receive at least one cable for hanging the light emitting diode lamp. The junction box forms an elongated ridge, and the lamp holder forms an elongated slot. The ridge and the slot slidably engage to enable detachable attachment between the junction box and the lamp holder. In this manner, multiple lamps may be arranged in series.

In one aspect, a modular illumination assembly, comprises:

at least one elongated lamp operational to emanate light, the at least one lamp defined by a lamp sidewall and a pair of lamp terminal walls that form a cavity, the at least one lamp comprising a light emitting diode;

a shield disposed along a portion of the lamp sidewall, the shield being adapted to cover about half the lamp sidewall, whereby the shield directionally guides the light emanating from the at least one lamp;

a pair of lamp holders retaining the pair of lamp terminal walls, the pair of lamp holders defined by a holder sidewall that forms a first mating surface, the pair of lamp holders comprising at least one adjustable retention member;

a circuitry and a switch for operation of the at least one lamp, the circuitry and the switch operatively connected to the pair of lamp holders and the at least one lamp;

at least one junction box defined by a junction box sidewall that forms a second mating surface, the at least one junction box operationally connected to the circuitry and the switch, the at least one junction box operational to regulate electrical current to the at least one lamp, whereby the first mating surface of the pair of lamp holders detachably mates with the second mating surface of the at least one junction box, whereby multiple lamps and multiple junction boxes are arranged in parallel series;

at least one anchor portion disposed on the pair of lamp holders, or the at least one junction box, or both, the at least one anchor portion adapted to receive at least one cable; and a power cord adapted to extend between the circuitry and an external power source.

In another aspect, the at least one lamp is a light emitting diode.

In another aspect, the at least one lamp has a tubular shape.

In another aspect, the shield is a semi-circular metal panel.

In another aspect, the shield covers about half the lamp sidewall.

In another aspect, the pair of lamp holders comprises a lid.

In another aspect, the first mating surface is an elongated slot.

In another aspect, the adjustable retention member is a tab and a threaded screw.

In another aspect, the at least one junction box comprises a junction box cover.

In another aspect, the second mating surface is an elongated ridge.

In another aspect, the anchor portion is a hole having a rubber perimeter.

In another aspect the switch is adapted to open and close the circuitry to electrical current.

In another aspect, the circuitry comprises a live wire and a null wire.

In another aspect, the cable is a chain cable that attaches to a ceiling.

In another aspect, the assembly comprises an external power source.

In another aspect, the assembly comprises a power cord adapted to extend between the at least one junction box and the external power source.

One objective of the present invention is to provide LED lamps that do not require a housing.

Another objective is to provide LED lamps that direct light away from the ceiling and towards the ground.

Yet another objective is to eliminate uneven light distribution and brightness from LED lamps.

Yet another objective is to eliminate high material and component costs of LED housings.

Yet another objective is to restrict lateral slippage of LED lamps with tabs and threaded screws at the termini of the lamps.

Yet another objective is to easily hang an LED lamp from the ceiling through use of an anchor portion at the termini of the LED lamp.

Yet another objective is to provide a junction box cover and a lid for the lamp holder to inhibit moisture and debris from engaging the circuitry.

Yet another objective is to provide an LED lamp that reduces difficult and time-consuming assembly, and cumbersome housing configurations that hamper installation and thus prevent custom applications.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like pans throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the, disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply, exemplary embodiments of the inventive concepts defined in the appended claims, Specific dimensions and other physical characteristics relating to the embodiments disclosed herein are therefore not to be considered as limiting, unless the claims expressly state otherwise.

A modular illumination assembly 100 is referenced in FIGS. 1-16. The modular illumination assembly 100, hereafter "assembly 110" is configured to enable at least one light emitting diode (LED) lamp 102*a-d* to operatively connect in parallel series each other through use of at least one junction box 128*a-f* that connects the lamps 102*a-d* in succession. The unique aspect of the assembly 100 is that a housing is not required for supporting and covering the lamps 102*a-d*. Rather, a pair of lamp holders 110*a-h* at the termini of the lamps 102*a-d* firmly retain the lamps position.

The junction boxes 128*a-f* regulate electrical current and connect the lamps 102*a-d*, while at least one cable 134*a-d* hangs the lamps 102*a-d* from the ceiling. In addition, the light that emanates from the lamps 102*a-d* is directionally guided away from the ceiling and towards the walls and floor with a shield 108*a-d* that at least partially covers the lamp 102*a-d*, so as to create optimal light efficiency. Thus, by not using a special housing to cover and support the lamps 102*a-d*, space is saved, material is saved, and aesthetics are enhanced.

Figure 2:
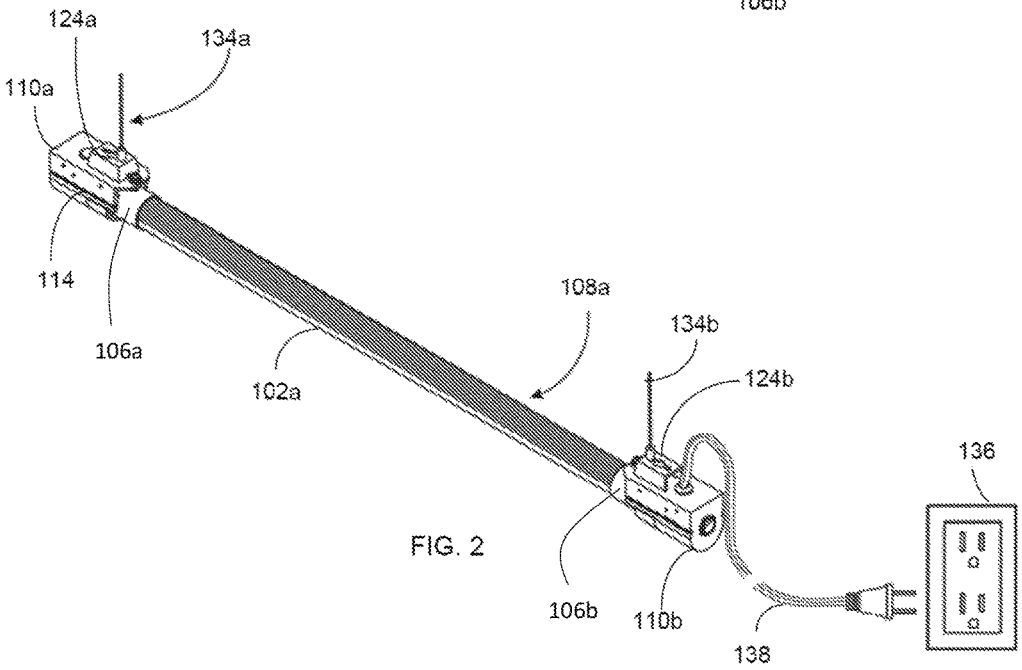
FIG. 2 illustrates a top angle perspective view of an exemplary modular illumination assembly, in accordance with an embodiment of the present invention.

Turning now to FIG. 2, the assembly 100 provides at least one elongated LED lamp 102*a* that is adapted to join multiple LED lamps 102*b*, 102*c*, 102*d* in a parallel arrangement, through connecting junction boxes 128*a-f*. A shield 108*a-d* at least partially covers the LED lamp 102*a*, so as to directionally guide the emitted light in a desired direction, such as towards a ground surface. A pair of lamp holders 110*a-h* retain the lamp 102*a* in position. A circuitry 116 and a switch 118 control electrical regulation for operation of the LED lamps 102*a-d*. The lamp holders 110*a-h* comprise an adjustable retention member 122*a*, 122*b* to fasten the termini of the LED lamp 102*a-d*. The retention members 122*a*, 122*b* include a tab 122*a* and a threaded screw 122*b* that restrict lateral slippage by the lamp 102*a-d*.

The lamp holders 110*a-h* also comprise an anchor portion 124*a-d* that is sized and dimensioned to receive the at least one cable 134*a-d* for hanging the LED lamp 102*a-d* from a ceiling. The junction box 128*a-f* forms an elongated ridge, and the lamp holder 110*a-h* forms an elongated slot. The ridge and the slot slidably engage to enable detachable attachment between the junction box 128*a-f* and the lamp holder 110*a-h*. In this manner, multiple LED lamps 102*a-d* may be arranged in parallel series.

As referenced in FIG. the assembly 100, comprises at least one elongated lamp 102*a-d* that is operational to emanate light. In one embodiment, the lamp 102*a-d* comprises an LED. Though in other embodiments, any halogen or light illuminating device may be used. The lamp 102*a-d* is defined by a lamp sidewall 104 and a pair of lamp terminal walls 106*a*, 106*b* (referring to FIGS. 1-2) that form a cavity. The at least one lamp 102*a-d* has a tubular shape. The lamp sidewall 104 may be transparent glass The cavity within the lamp sidewall 104 may contain a filament, wiring, and halogen gases that generates a light when electrical current pass through. The generated light may be any color known in the art.

In some embodiments, a shield 108*a-d* is disposed along a portion of the lamp sidewall 104. In one embodiment, the shield 108*a-d* is a semi-circular metal panel that covers at least half the surface area of the lamp sidewall 104. The shield 108*a-d* directionally guides the light emanating from the at least one elongated lamp 102*a-d*. The shield 108*a-d* can be adjusted to cover any amount of the lamp sidewall 104 and rotatably oriented around the lamp sidewall 104 to direct the light in multiple directions and intensities.

Figure 4:
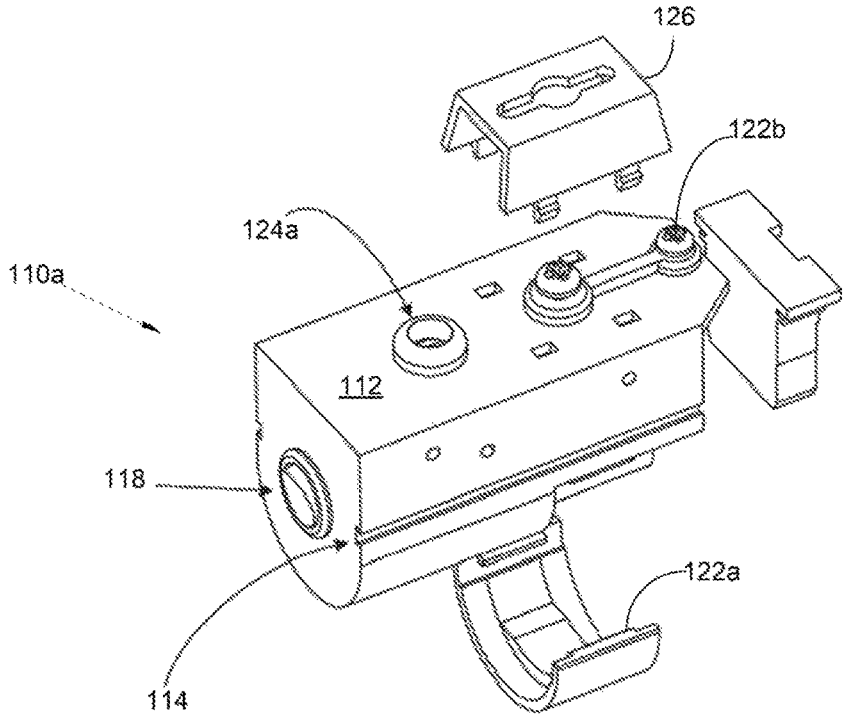
FIG. 4 illustrates a close up view of an exemplary lamp holder, in accordance with an embodiment of the present invention.
Figure 5:
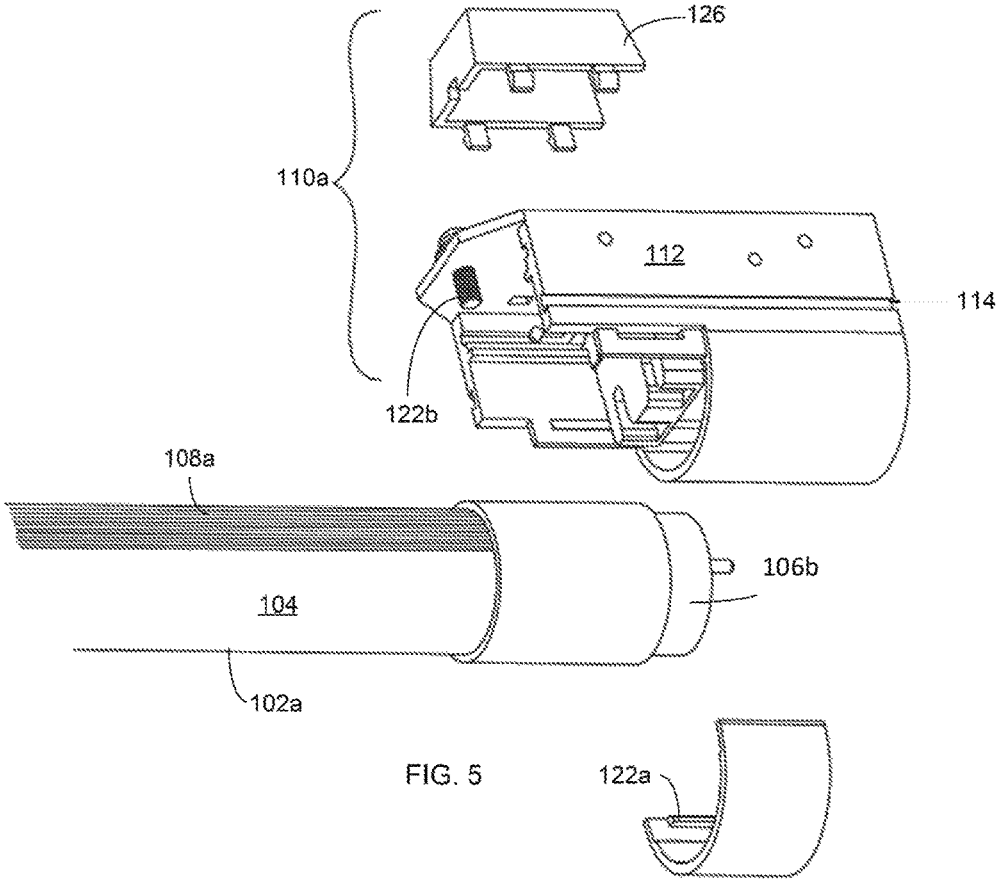
FIG. 5 illustrates a perspective view of a lamp holder detached from a lamp, in accordance with an embodiment of the present invention.

Turning now to FIG. 4, a pair of lamp holders 110*a-h* engage the pair of lamp terminal walls 106*a*, 106*h* (referring to FIGS. 1-2) to snugly retain the lamp 102*a* in an operational position. The lamp holders 110*a-h* are defined by a bolder sidewall 112. The holder sidewall 112 may form a generally rectangular shape containing a cavity. A circuitry 116 and the switch 118 pass through the cavity in the lamp holder 110*a-h*. In one embodiment, the holder sidewall 112 forms a first mating surface 114 that is used to connect multiple lamps 102*a-d* and junction boxes 128*a-f* in parallel series, as described below. FIG. 5 illustrates the first mating surface 114 as an elongated slot. Perforations may be adapted along the elongated slot to enhance grip with a second mating surface 132.

Figure 6:
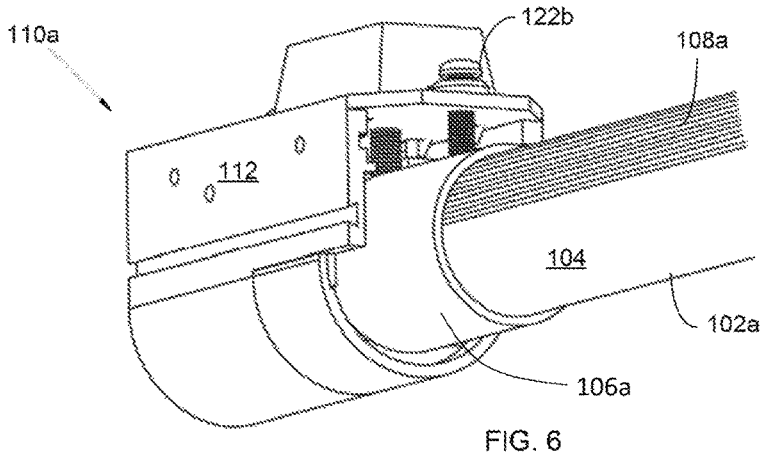
FIG. 6 illustrates a perspective view of a lamp holder mounted to a lamp, in accordance with an embodiment of the present invention.

As shown in the blow up view of FIG. 6, the lamp holders 110*a-h* comprise a circuitry 116 and a switch 118 for operation of the at least one elongated lamp 102*a-d*. In one embodiment, the circuitry 116 is a series of wires, resistors, and transformers known in the arts to carry electrical current for operation of an LED lamp 102*a*. In one embodiment the circuitry 116 comprises a live wire 120*a*, or hot wire, and a null wire 120*b*, or ground. The switch 118 is adapted to open and close the circuitry 116 to regulate electrical current, i.e. turn on and off the light. The switch 118 may include a button that is the placed between an On position and an Off position. The position of the switch 118 near the lamp terminal wall 106*a-b* (referring to FIG. 5) and facilitates access or powering on and off the LED lamp 102*a-d*.

Figure 9:
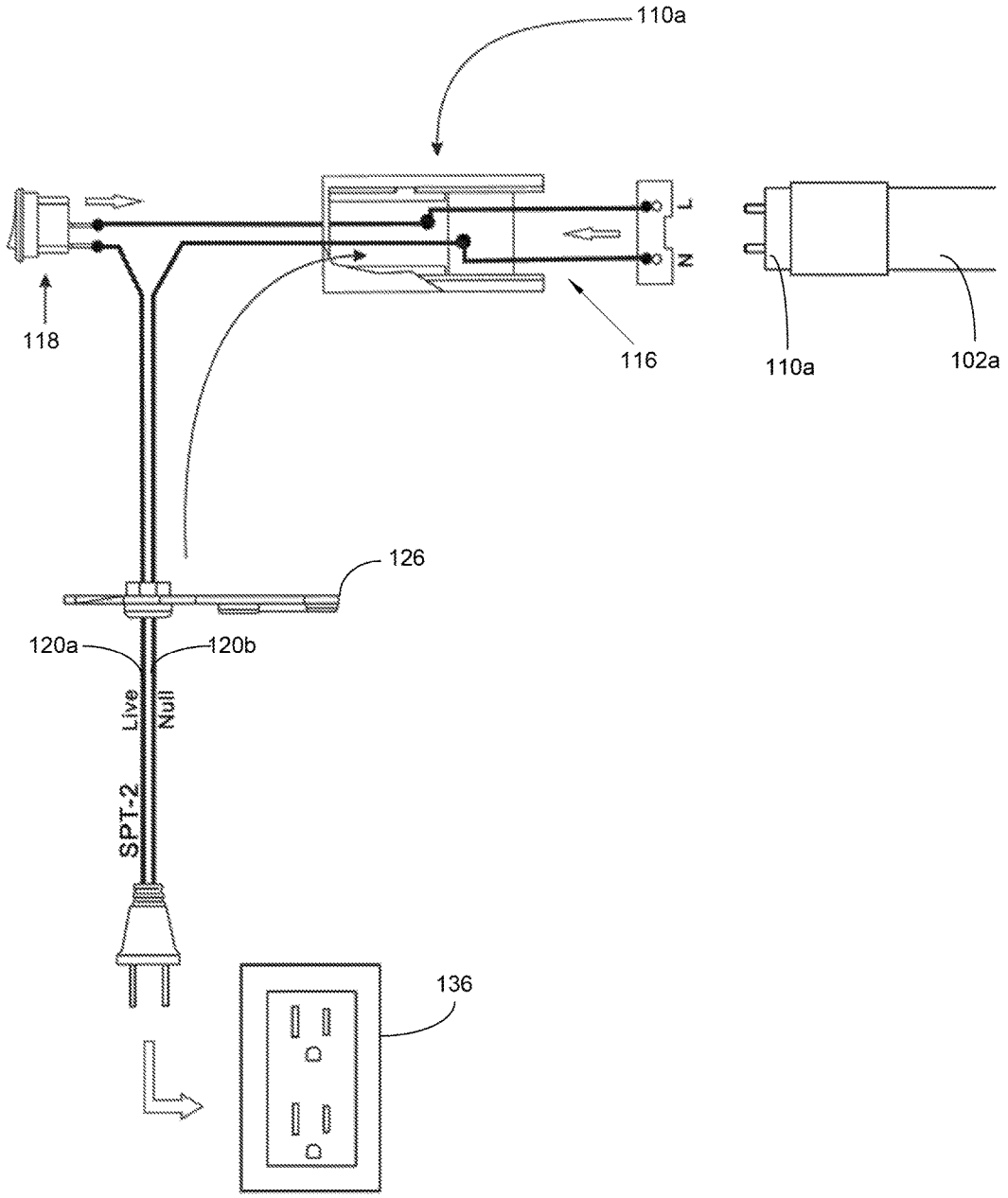
FIG. 9 illustrates a schematic view of an exemplary modular illumination assembly with one lamp, in accordance with an embodiment of the present invention.
Figure 10:
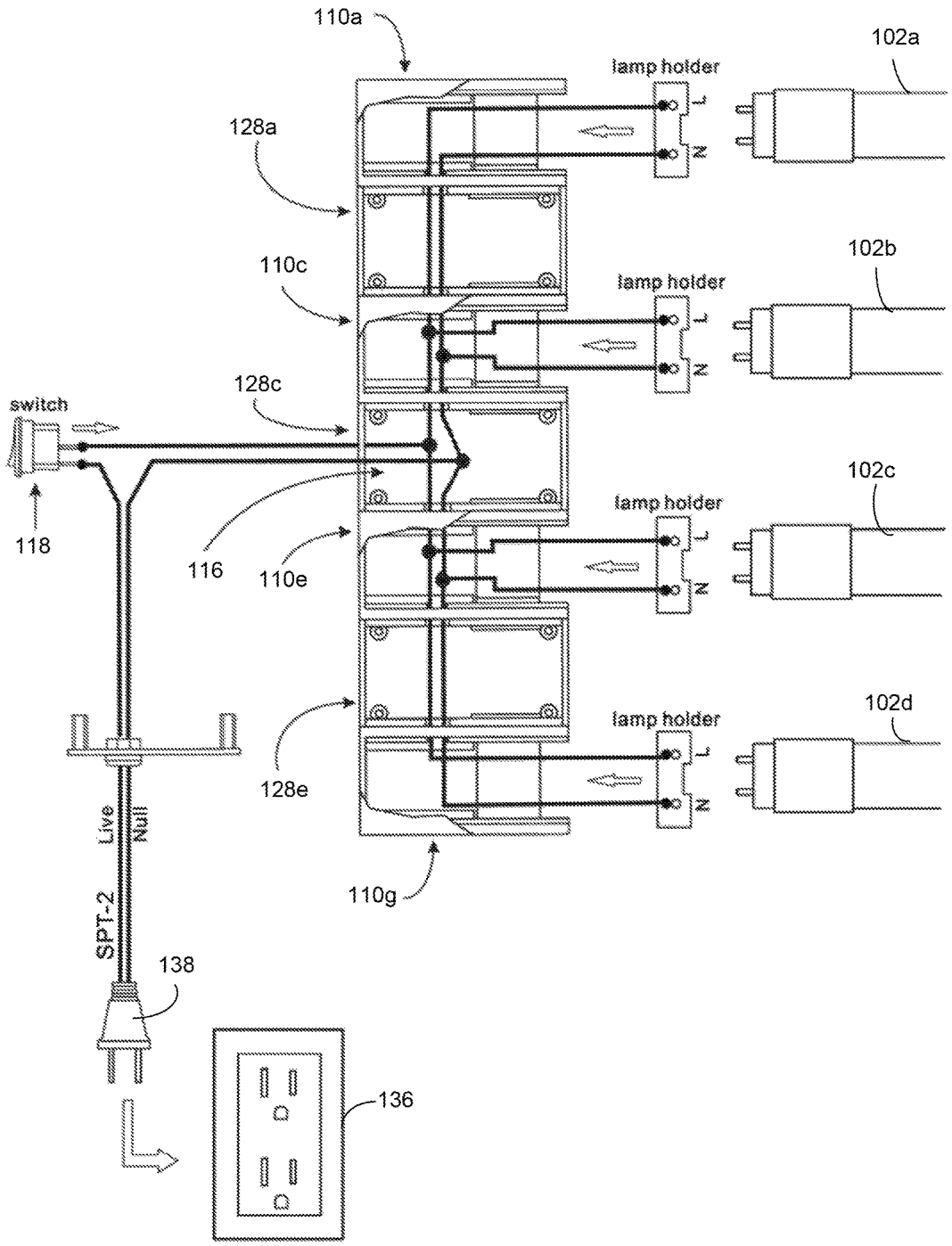
FIG. 10 illustrates a schematic view of an exemplary modular illumination assembly with four lamps, in accordance with an embodiment of the present invention.

Looking ahead to FIG. 9, the assembly 100 comprises an external power source 136 that provides the electrical current for the lamp 102*a-d*. The external power source 136 may include an AC socket, known in the art to provide electrical power to light sources. In some embodiments, the assembly 100 provides a power cord 138 that is adapted to extend between the junction box 128*a-f* and the external power source 136. In one embodiment, the power cord 138 is an SPT-2 wire cord. Though other types of power cords may be used. In one alternative embodiment, a battery may be used to power the lamp 102*a-d*.

Figure 1:
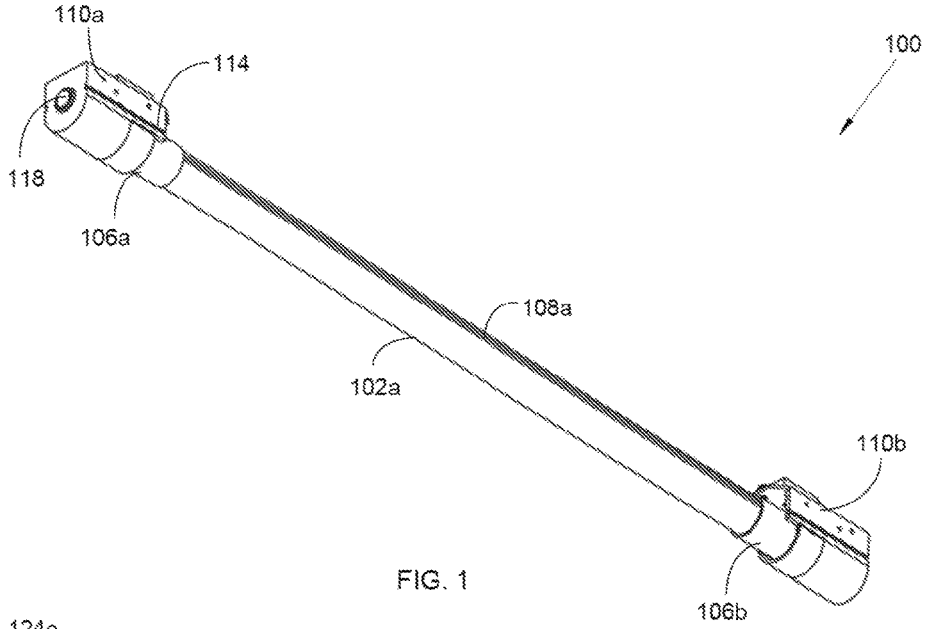
FIG. 1 illustrates a bottom angle perspective view of an exemplary modular illumination assembly, in accordance with an embodiment of the present invention.
Figure 3:
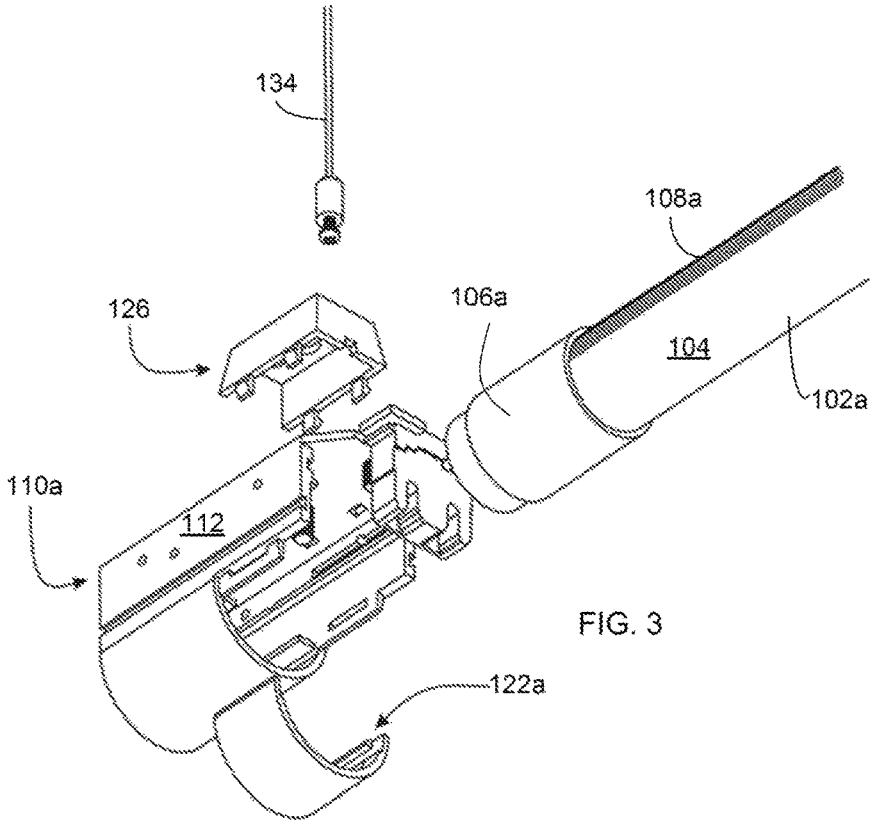
FIG. 3 illustrates a blow up view of an exemplary lamp holder, in accordance with an embodiment of the present invention.

Looking again at FIG. 3, the pair of lamp holders 110*a-h* comprises a lid 126. The lid 126 forms a seal for a cavity in the lamp holder 110*a-h*, so as to inhibit moisture and debris from reaching the circuitry 116 and the switch 118. The pair of lamp holders 110*a-h* further comprising an adjustable retention member 122*a*, 122*b* for adjustably fastening the pair of lamp terminal walls 106*a*, 106*b* (referring to. FIGS. 1-2) to restrict lateral slippage by the at least one elongated lamp 102*a-d*. In one embodiment, the adjustable retention member 122*a*, 122*b* is a tab and a threaded screw. The tab forms a friction fit relationship with the terminal ends of the lamp 101*a-d*. The threaded screw can be rotated clockwise or counterclockwise to secure or loosen the lamps 102*a-d* from their respective lamp holders 110*a-h*.

Figure 7:
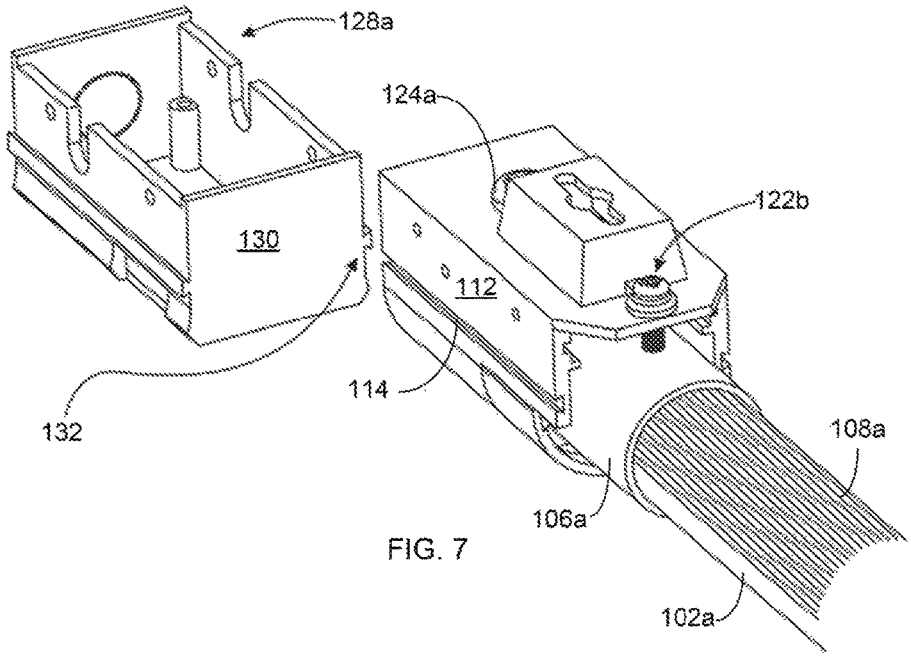
FIG. 7 illustrates a perspective view of an exemplary junction box and a lamp holder detached from a lamp, in accordance with an embodiment of the present invention.

As referenced in FIG. 7, the assembly 100 provides at least one junction box 128*a-f*. The junction box 128*a-f* is operational to regulate electrical current to the at least one elongated lamp 102*a-d*. In essence, the junction box 128*a-f* serves as a receptacle retain and orient wires, splices, and other electrical components that feed into the LED lamp 102*a-d*.

Figure 8:
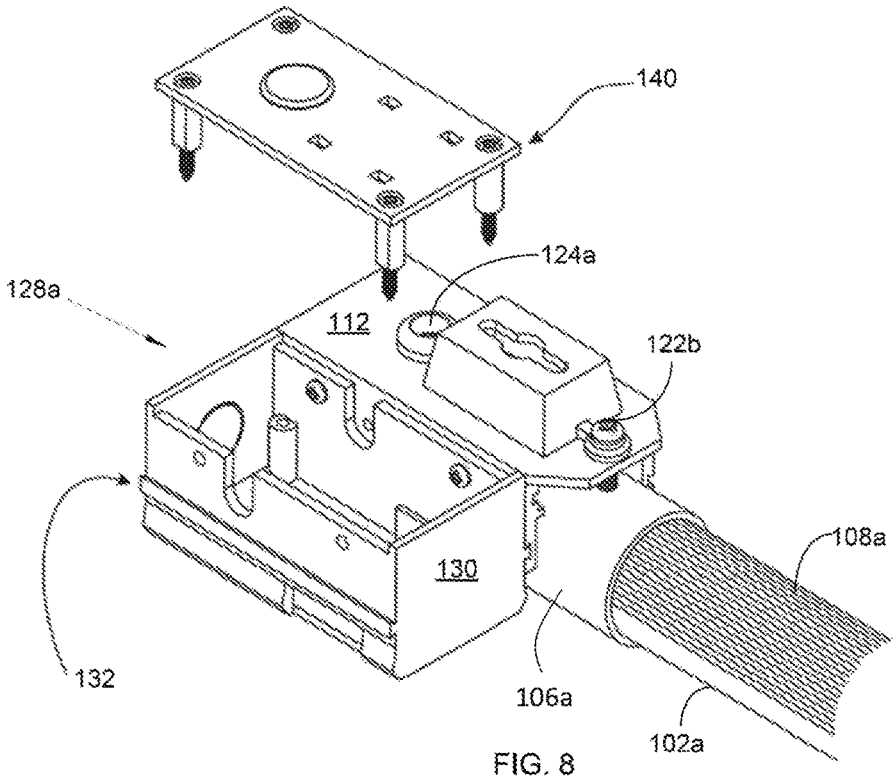
FIG. 8 illustrates a perspective view of the junction box and the lamp holder shown in FIG. 7 mounted to the lamp, in accordance with an embodiment of the present invention.

Looking at FIG. 8, the junction box 128*a-f* comprises a junction box cover 140. The junction box cover 140 forms a seal with a cavity in the junction box 128*a-f*, so as to inhibit moisture and debris from reaching the circuitry 116 contained therein. Screws may be used to fasten junction box cover 140 in place.

Turning again to FIG. 8, the junction box 128*a-f* may be defined by a junction box sidewall 130, forming a generally rectangular shape. The junction box sidewall 130 is defined by a second mating surface 132. In some embodiments, the second mating surface 132 is an elongated ridge that runs along the length of the junction box 128*a-f*. Though in other embodiments, the second mating surface 132 may include, without limitation, a latch, a friction fit mechanism, a magnet, a screw, and an adhesive.

The first mating surface 114 of the lamp holders 110*a-h* detachably mates with the second mating surface 132 of the junction box 128*a-f* in a slidable relationship. In this manner, multiple lamp 102*a-ds* and multiple junction boxes 128*a-f* may be easily arranged in parallel series. In some embodiments, multiple lamp 102*a-ds* are joined in parallel through multiple junction boxes 128*a-f*. This is illustrated in the schematic diagram of FIG. 10. Here, three junction boxes 128*a*, 128*c*, 128*e* are operationally connected to the circuitry 116 and the switch 118 of the lamp holders 110*a*, 110*c*, 110*e*, 110*g*.

The lamp holders 110*a-h* or the junction box 128*a-f* may detachably attach to at least one anchor portion 124*a-d* that is adapted to receive at least one cable 134*a-d*. The cable 134*a-d* enables the lamp 102*a-d* to hang from a ceiling or other mounting surface. In some embodiments the anchor portion 124*a-d* is defined by a hole having a rubber perimeter. The cable 134*a-d* extends from the ceiling to attach to the anchor portion 124*a-d*, and thereby allow the lamp 102*a-d* to hang from the ceiling without requiring a large housing to mount the lamp 102*a-d*.

In one embodiment, the cable 134*a-d* is a chain cable that attaches to a ceiling from a first end, and to the anchor portion 124*a-d* from a second end. The cable 134*a-d* can be length adjusted. Also, the cable 134*a-d* can swing freely from the ceiling. This flexible mounting capability allows the assembly 100 to hang from different sizes and dimensions of ceiling, and also be operational in different types of buildings.

Figure 11:
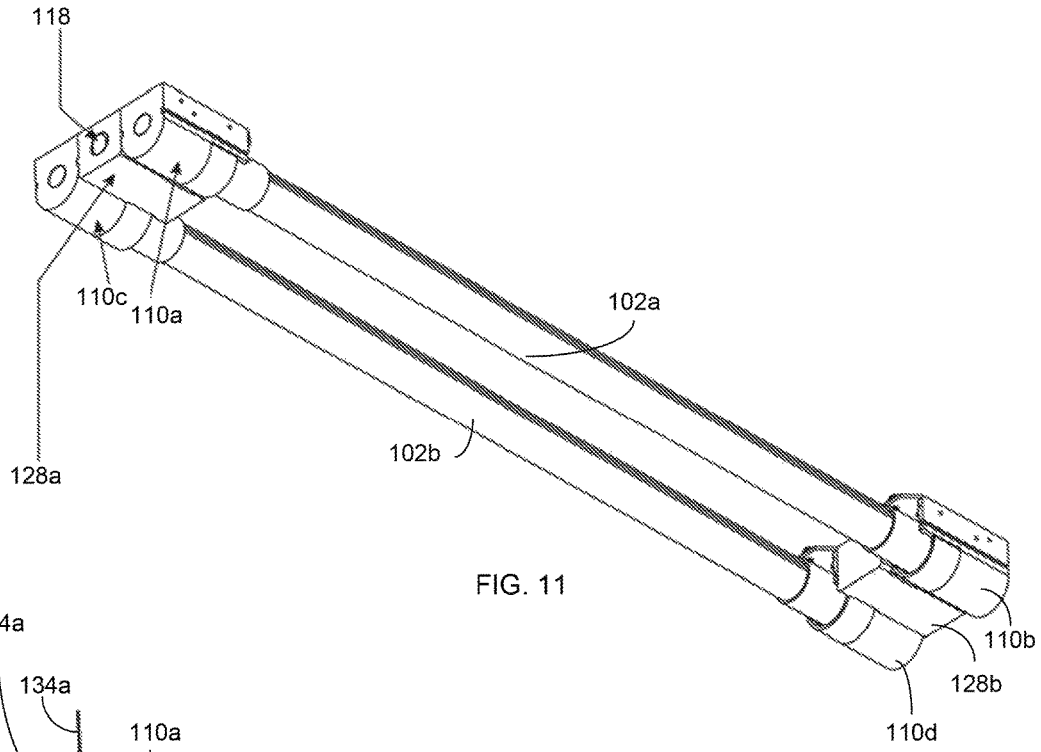
FIG. 11 illustrates a bottom angle perspective view of an exemplary modular illumination assembly with two lamps, in accordance with an embodiment of the present invention.
Figure 12:
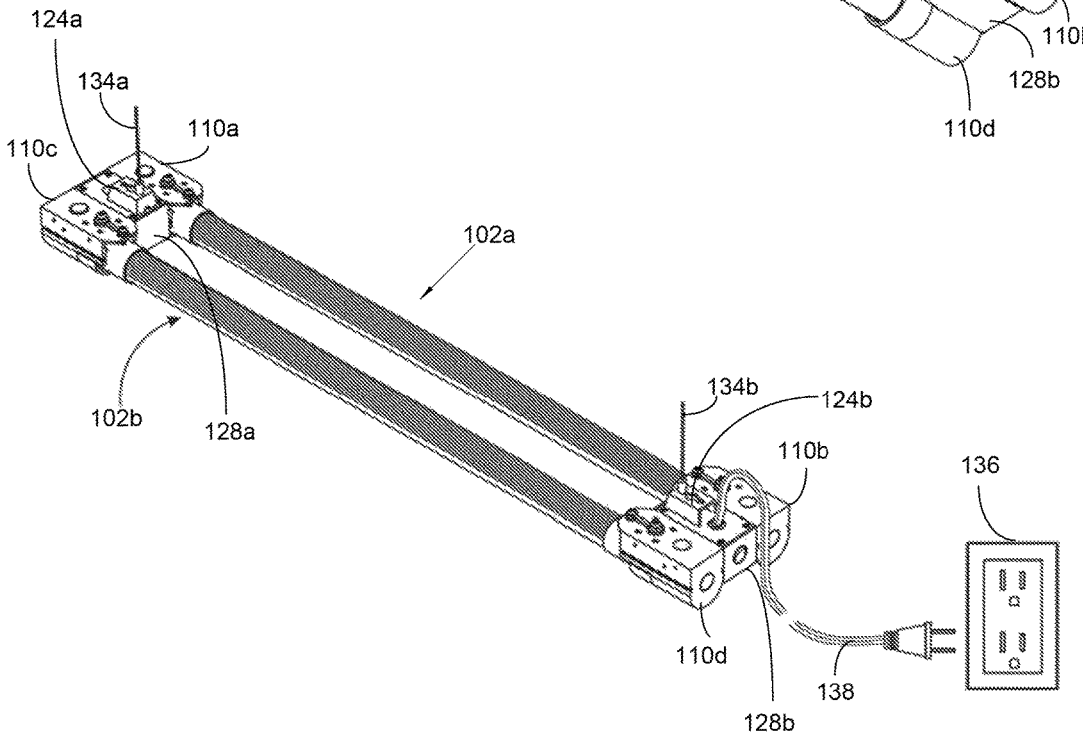
FIG. 12 illustrates a top angle perspective view of an exemplary modular illumination assembly with two lamps, in accordance with an embodiment of the present invention.

As discussed above, the first mating surface 114 of the lamp holders 110*a-h* detachably mates with the second mating surface 132 of the junction box 128*a-f*. In this manner, multiple lamp 102*a-ds* and multiple junction boxes 128*a-f* are arranged in parallel series. For example, FIGS. 11 and 12 illustrate upper and lower perspective view of two LED lamp 102*a-ds* arranged in parallel series with one pair of junction boxes 128*a-f* operational between two corresponding LED lamp 102*a-ds*.

Figure 13:
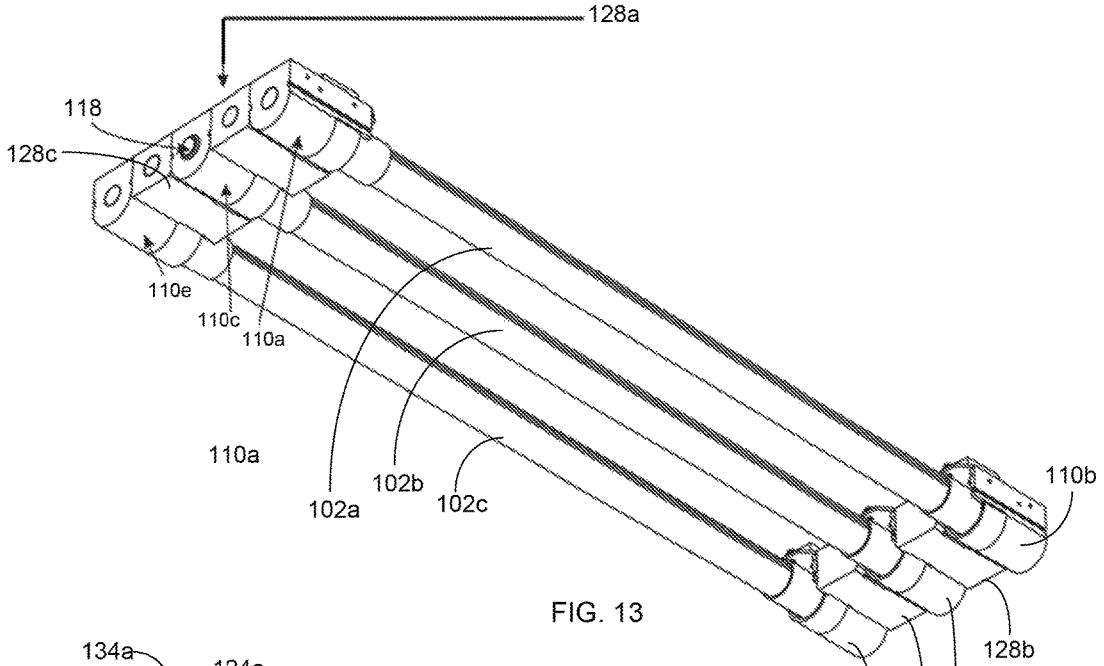
FIG. 13 illustrates a bottom angle perspective view of an exemplary modular illumination assembly with three lamps, in accordance with an embodiment of the present invention.
Figure 14:
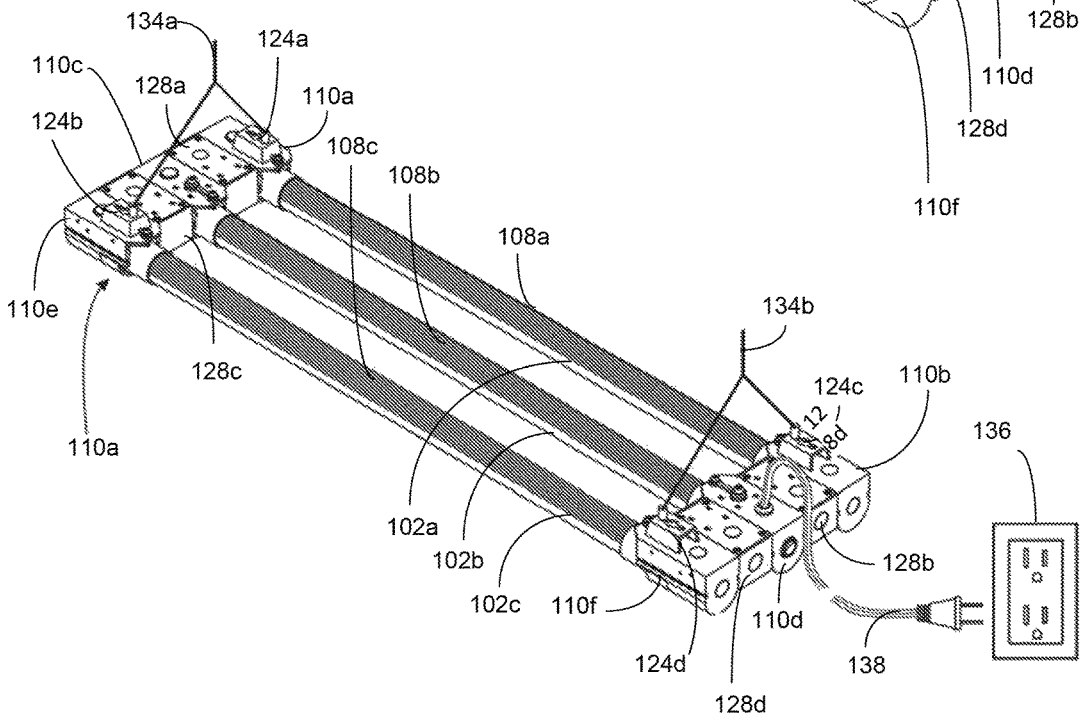
FIG. 14 illustrates a top angle perspective view of an exemplary modular illumination assembly with three lamps, in accordance with an embodiment of the present invention.
Figure 15:
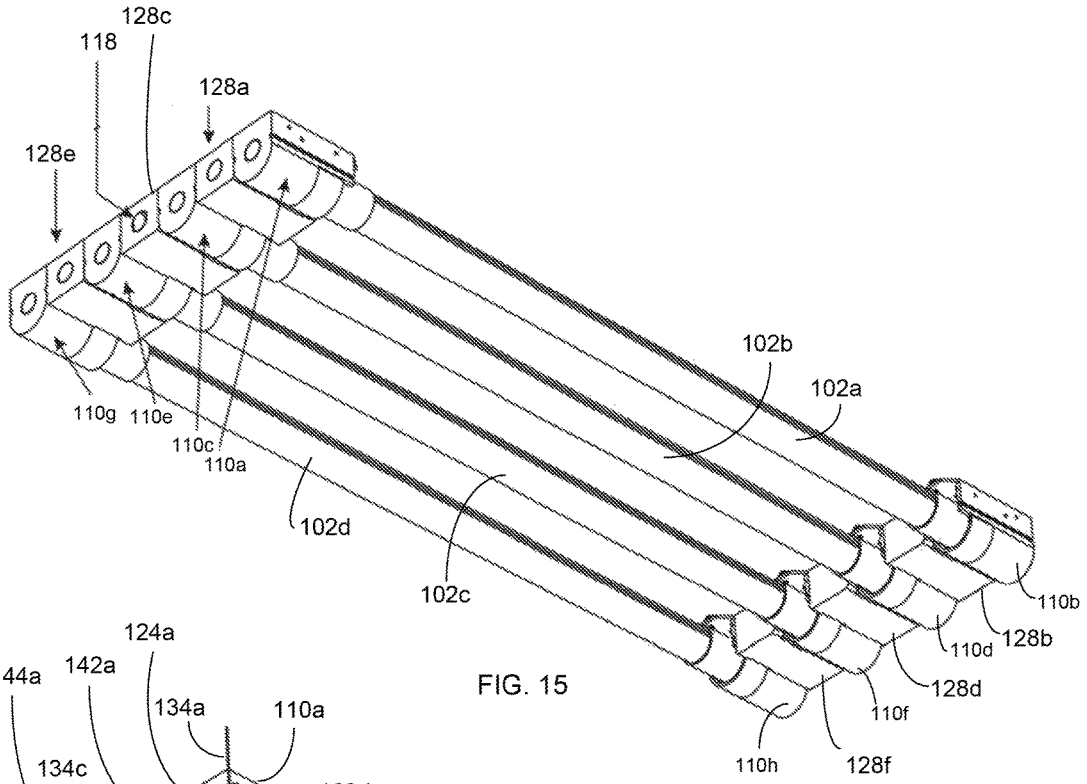
FIG. 15 illustrates a bottom angle perspective view of an exemplary modular illumination assembly with four lamps, in accordance with an embodiment of the present invention.
Figure 16:
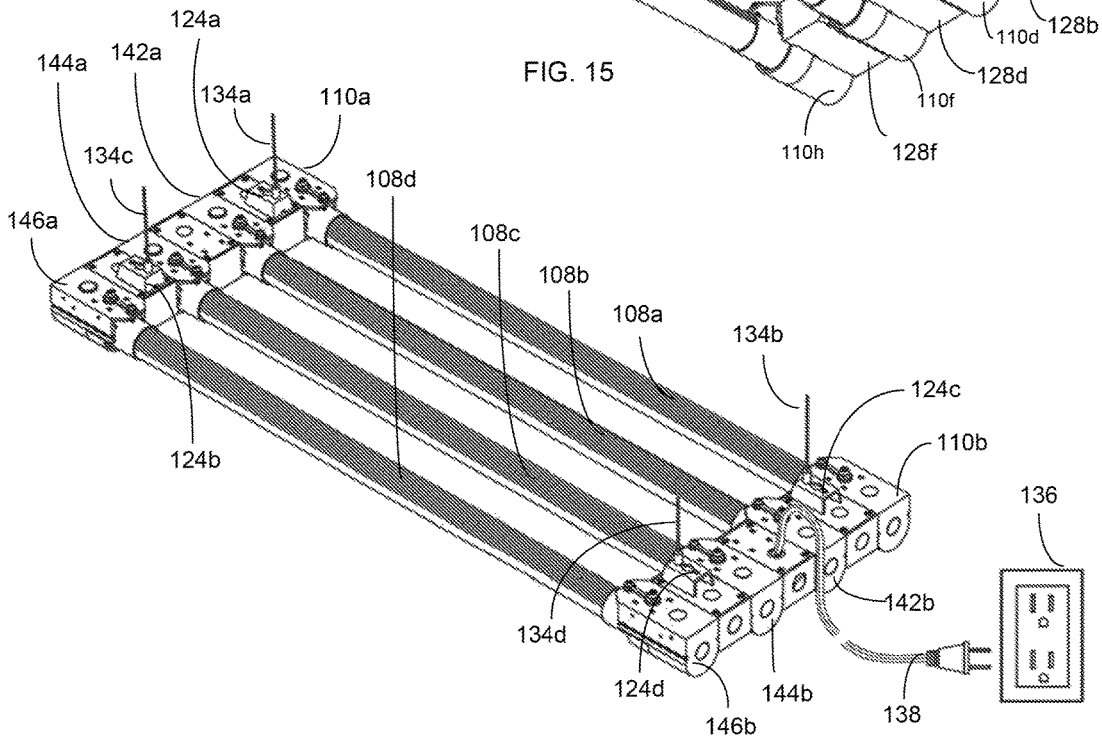
FIG. 16 illustrates a top angle perspective view of an exemplary modular illumination assembly with four lamps in accordance with an embodiment of the present invention.

Additionally, FIGS. 13 and 14 illustrate upper and lower perspective view of three LED lamps 102*a*, 102*b*, 102*c* arranged in parallel series with two pairs of junction boxes 128*a*, 128*b*, 128*c*, 128*d* operational between three corresponding LED lamps 102*a-c*. Furthermore, FIGS. 15 and 16 illustrate upper and lower perspective view of four LED lamps 102*a-d* arranged in parallel series with three pairs of junction boxes 128*a*, 128*b*, 128*c*, 128*d*, 128*e*, 128*f* operational between four corresponding LED lamps 102*a-d*. In all of these multi-lamp 102*a-d* arrangements, a switch 118 is operational at the lamp holders 110*a-h* or the junction boxes 128*a-f*, and the cable 134*a-d* supports the entire assembly 100 from the anchor portion 124*a*, 124*b*, 124*c*, 124*d* disposed at the lamp holder 110*a-h*, or the junction boxes 128*a-f*, or both.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A modular illumination assembly, the assembly comprising:

at least one lamp operational to emanate light, the at least one lamp defined by a lamp sidewall and a pair of lamp terminal walls that form a cavity;

a shield disposed along a portion of the lamp sidewall, whereby the shield directionally guides the light emanating from the at least one lamp;

a pair of lamp holders retaining the pair of lamp terminal walls, the pair of lamp holders defined by a holder sidewall that forms a first mating surface, the pair of lamp holders comprising at least one adjustable retention member;

a circuitry and a switch for operation of the at least one lamp, the circuitry and the switch operatively connected to the pair of lamp holders and the at least one lamp;

at least one junction box defined by a junction box sidewall that forms a second mating surface, the at least one junction box operationally connected to the circuitry and the switch, the at least one junction box operational to regulate electrical current to the at least one lamp, whereby the first mating surface of the pair of lamp holders detachably mates with the second mating surface of the at least one junction box, whereby multiple lamps and multiple junction boxes are arranged in parallel series; and at least one anchor portion disposed on the pair of lamp holders, or the at least one junction box, or both; wherein the at least one lamp comprises a longitudinal axis, and whereby the multiple lamps are connected by interposing the multiple junction boxes in a side-by-side arrangement so that the longitudinal axis of each of the multiple lamps are parallel and not intersecting.

2. The assembly of claim 1, wherein the at least one lamp is a light emitting diode.

3. The assembly of clan 1, wherein the at least one lamp has a tubular shape.

4. The assembly of claim 1, wherein the shield is a semi-circular metal panel.

5. The assembly of claim 1, wherein the shield is adapted to cover about half the lamp sidewall.

6. The assembly of claim 1, wherein the pair of lamp holders comprises a lid.

7. The assembly of claim 1, wherein the first mating surface is an elongated slot.

8. The assembly of claim 1, wherein the at least one adjustable retention member comprises a tab and a threaded screw.

9. The assembly of claim 1, wherein the at least one adjustable retention member is adapted for fastening the pair of lamp terminal walls to restrict lateral slippage by the at least one elongated lamp.

10. The assembly of claim 1, wherein the at least one junction box comprises a junction box cover.

11. The assembly of claim 1, wherein the second mating surface is an elongated ridge.

12. The assembly of claim 1, wherein the switch is adapted to open and close the circuitry to electrical current.

13. The assembly of claim 1, wherein the circuitry comprises a live wire and a null wire.

14. The assembly of claim 1, wherein the at least one anchor portion is defined by a hole having a rubber perimeter.

15. The assembly of claim 14, further comprising at least one cable adapted to join with the at least one anchor portion.

16. The assembly of claim 15, wherein the at least one cable is a chain cable that attaches to a ceiling.

17. The assembly of claim 1, further comprising an external power source.

18. The assembly of claim 17, further comprising a power cord adapted to extend between the circuitry and the external power source.

19. A modular illumination assembly, the assembly comprising:

at least one elongated lamp operational to emanate light, the at least one lamp defined by a lamp sidewall and a pair of lamp terminal walls that form a cavity, the at least one lamp comprising a light emitting diode;

a shield disposed along a portion of the lamp sidewall, the shield being adapted to cover about half the lamp sidewall, whereby the shield directionally guides the light emanating from the at least one lamp;

a pair of lamp holders retaining the pair of lamp terminal walls, the pair of lamp holders defined by a holder sidewall that forms a first mating surface, the pair of lamp holders comprising at least one adjustable retention member;

a circuitry and a switch for operation of the at least one lamp, the circuitry and the switch operatively connected to the pair of lamp holders and the at least one lamp;

at least one junction box defined by a junction box sidewall that forms a second mating surface, the at least one junction box operationally connected to the circuitry and the switch, the at least one junction box operational to regulate electrical current to the at least one lamp, whereby the first mating surface of the pair of lamp holders detachably mates with the second mating surface of the at least one junction box, whereby multiple lamps and multiple junction boxes are arranged in parallel series;

at least one anchor portion disposed on the pair of lamp holders, or the at least one junction box, or both, the at least one anchor portion adapted to receive at least one cable; and a power cord adapted to extend between the circuitry and an external power source; wherein the at least one lamp comprises a longitudinal axis, and whereby the multiple lamps are connected by interposing the multiple junction boxes in a side-by-side arrangement so that the longitudinal axis of each of the multiple lamps are parallel and not intersecting.

20. A modular illumination assembly, the assembly consisting of:

at least one elongated light emitting diode lamp operational to emanate light, the at least one light emitting diode lamp defined by a lamp sidewall and a pair of lamp terminal walls that form a cavity;

a shield disposed along a portion of the lamp sidewall, the shield being adapted to cover about half the lamp sidewall, whereby the shield directionally guides the light emanating from the at least one light emitting diode lamp;

a pair of lamp holders retaining the pair of lamp terminal walls, pair of lamp holders comprising a lid, the pair of lamp holders defined by a holder sidewall that forms an elongated slot, the pair of lamp holders comprising at least one adjustable retention member, the at least one adjustable retention member comprising a tab and a threaded screw;

a circuitry and a switch for operation of the at least one light emitting diode lamp, the circuitry and the switch operatively connected to the pair of lamp holders and the at least one light emitting diode lamp;

at least one junction box defined by a junction box sidewall that forms an elongated ridge, the at least one junction box comprising a junction box cover, the at least one junction box operationally connected to the circuitry and the switch, the at least one junction box operational to regulate electrical current to the at least one light emitting diode lamp, whereby the first mating surface of the pair of lamp holders detachably mates with the second mating surface of the at least one junction box, whereby multiple light emitting diode lamps and multiple junction boxes are arranged in parallel series;

at least one anchor portion disposed on the pair of lamp holders, or the at least one junction box, or both, the at least one anchor portion adapted to receive at least one cable; and a power cord adapted to extend between the circuitry and an external power source; wherein the at least one lamp comprises a longitudinal axis, and whereby the multiple light emitting diode lamps are connected by interposing the multiple junction boxes in a side-by-side arrangement so that the longitudinal axis of each of the multiple lamps are parallel and not intersecting.

* * * * *